United States Patent [19]

Hebda

[11] 3,952,452

[45] Apr. 27, 1976

[54] DEVICE FOR ASSISTING THE OPENING OF A DOOR

[76] Inventor: Thomas Hebda, 235 Vance, Lombard, Ill. 60148

[22] Filed: Mar. 14, 1974

[21] Appl. No.: 451,042

[52] U.S. Cl. ..... 49/3; 98/39

[51] Int. Cl.[2] ..... E05F 15/20

[58] Field of Search ..... 49/1–8; 98/39; 236/49

[56] References Cited

UNITED STATES PATENTS

| | | | |
|---|---|---|---|
| 734,598 | 7/1903 | Plucker | 49/3 X |
| 777,648 | 12/1904 | Ballinger et al. | 49/3 |
| 3,337,990 | 8/1967 | Iwata | 49/3 |
| 3,817,161 | 6/1974 | Koplon | 98/39 |

FOREIGN PATENTS OR APPLICATIONS

| | | | |
|---|---|---|---|
| 155,015 | 12/1920 | United Kingdom | 49/194 |

*Primary Examiner*—Kenneth Downey

[57] ABSTRACT

Apparatus for assisting the opening of a door when the door is subjected to added air pressure tending to hold the door closed, the apparatus including means operable when the pressure comes to be applied for urging the door toward opened position thus compensating or partially compensating for the effect of the added air pressure. Preferably, such means includes a weight and means which when actuated releases the weight to cause the weight to be applied to urge the door to an open position.

4 Claims, 3 Drawing Figures

DEVICE FOR ASSISTING THE OPENING OF A DOOR

This invention relates to a device for assisting the opening of a door, and particularly to such a device where the door to be opened is subjected to pressure above atmospheric pressure and which would be difficult to open against such pressure.

BACKGROUND

It is common to provide spring or air cushion devices which operate to open or close doors, but there are situations where a door is subjected to pressures which make opening the door by hand very difficult or impossible. One such situation is the fire escape stairwell which is commonly contructed in multi-story buildings. Such stairwells extend between floors of the building and have doors to each of the floors. A main function of such stairwells is to provide an escape for occupants on a floor in the event of a fire, and at the same time prevent the spreading of a fire between floors.

More recently it has been the practice to provide an air blower which in the event of a fire alarm will create a pressure in the chamber defined by the stairwell so that when the door to the stairwell is opened on any floor on which there is a fire the draft will be from the interior toward the exterior of the chamber rather than from the floor into the stairwell. The effect of this is to keep the fire from entering the stairwell and passing to other floors.

One difficulty with such an arrangement is that the pressure generated by the blower is applied to the inside of the door and it is difficult or impossible to move the door by hand about its hinges into the stairwell to open the door. Further, it is necessary that the door be opened and closed normally in the absence of any fire alarm.

I have set myself to the problem presented by a situation such as that above described and have devised apparatus and methods which will assist in the opening of the door when the pressure is applied but which will allow the normal opening and closing of the door without interference when the pressure is not being applied.

DETAILED DESCRIPTION

Figure 2:
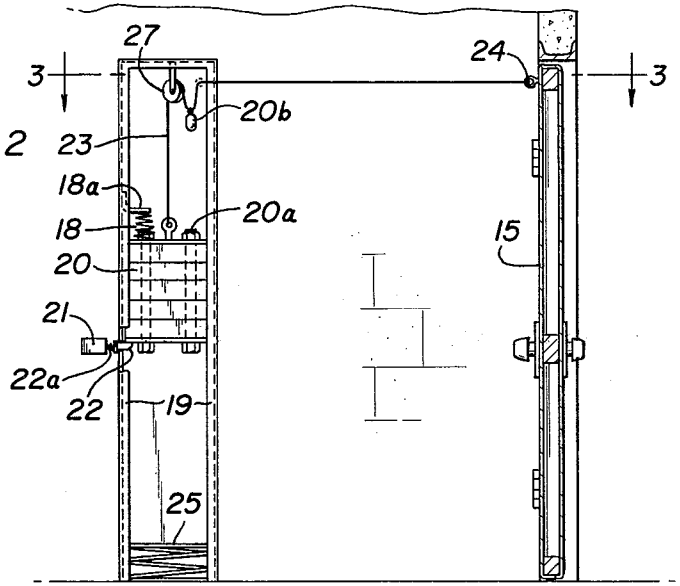
Figure 3:
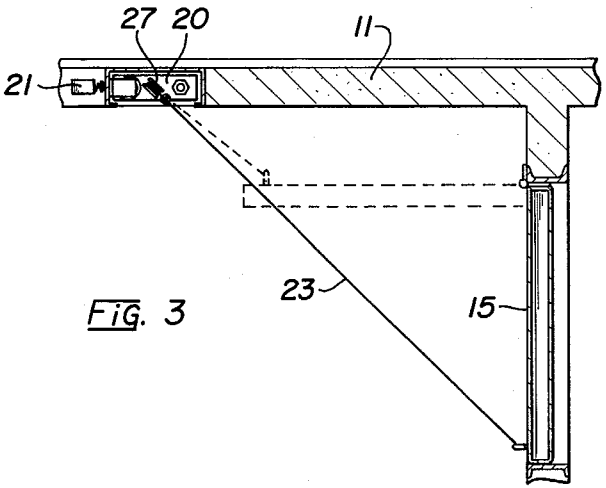
Figure 1:
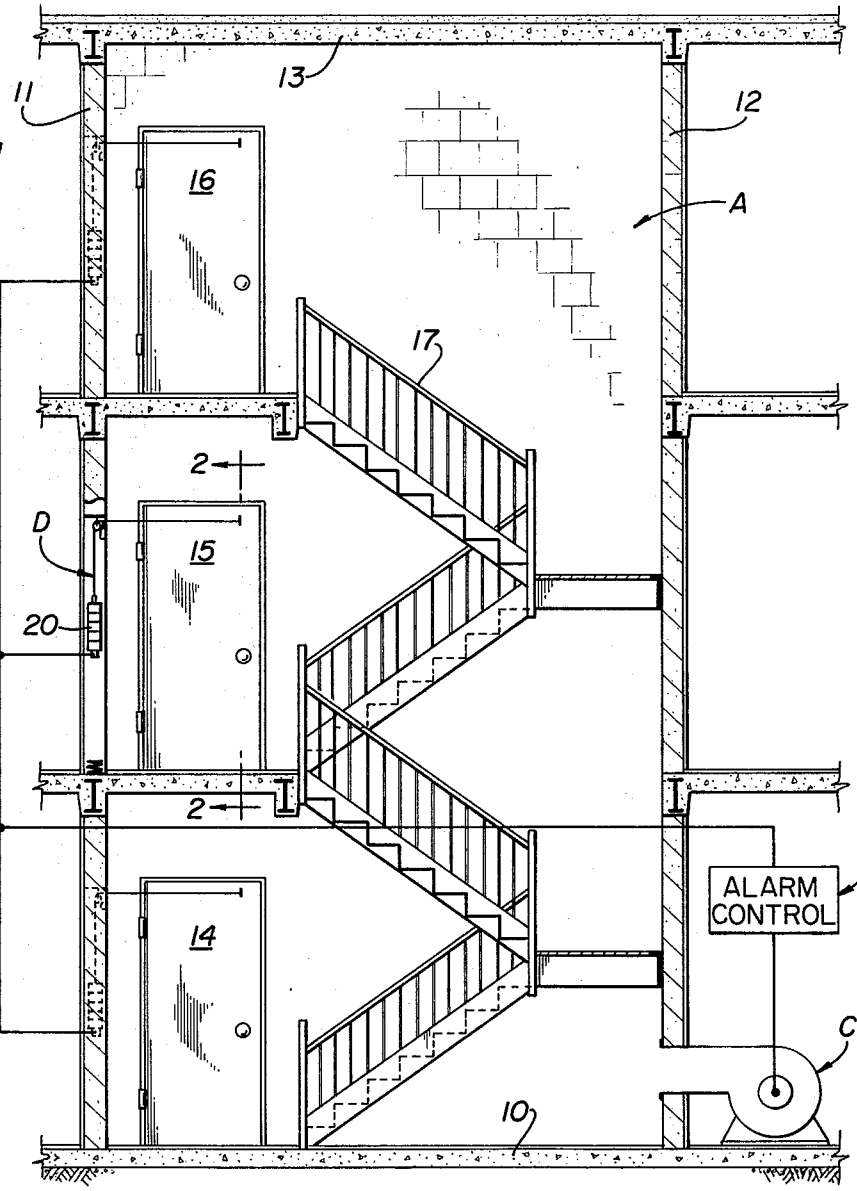

One embodiment of my invention is illustrated in the accompanying drawings in which FIG. 1 is a schematic elevational view of a stairwell which connects the floors of a building and in which my improved device has been installed;

FIG. 2 is an enlarged elevational view of apparatus connected to a door of the stairwell in accordance with my invention, the view being taken as seen from line 2—2 of FIG. 1; and FIG. 3 is a plan view of the apparatus shown in FIG. 2.

As illustrated in FIG. 1 the stairwell here shown provides a chamber A within the boundary of walls 11 and 12 and the ceiling 13. This chamber connects with the first floor through door 14, with the second floor through door 15, and with the third floor through door 16. An open stairway 17 leads from the first to the second floor and then to the third floor.

A fire alarm system B is provided and this is arranged as in well known systems to provide an electrical signal when on any floor someone acts to actuate the alarm.

The blower C is sensitive to the fire alarm signal and in response to this signal begins to operate and generate air pressure in chamber A which pressure extends throughout the chamber and against each of doors 14, 15 and 16. This pressure operates to create a draft of air from the inside toward the exterior of chamber A when either of doors 14 to 16 is opened, and so prevents entrance of fire from any floor into the stairwell.

To compensate for the effect of such pressures on the doors I provide mechanism D which is sensitive to the signal produced by the alarm system and which will urge the doors toward open position when such signal is received. In FIG. 1 this mechanism is shown only as applied to door 15 on the second floor, but may be applied to each of the first or third floor doors in the same way.

In the embodiment illustrated, mechanism D includes a vertical track 19 in wall 11 in which a weight 20 is disposed. For easy adjustment weight 20 is composed of several discs which are secured together by the fastening bolts 20a. To support weight 20 I provide the solenoid 21 in which is contained the slidable bolt or detent 22. The solenoid is made secure with the wall and the detent is associated with a spring 22a which presses it to its extended position where its end portion is beneath the weight 20, as shown in FIG. 2.

A cable 23 is connected with weight 20 at its top side. This cable extends over pulley 27 fastened to the wall, and thence to the front edge portion of the door 15 where the other end of the cable is attached to the eyepiece 24 in the door. The arrangement is such that when the solenoid 21 is actuated the bolt 22 is withdrawn to a position where it no longer extends beneath the weight 20 and therefore no longer supports this weight, allowing the weight to pull on the cable 23 thus urging the door 15 toward open position as shown in dotted lines in FIG. 3.

When the detent 22 is thus withdrawn the weight may move downwardly within the track 19 as the door is opened. I prefer that the cord 23 be long enough so that when the door is closed the weight 20 will be drawn up to the position in which the detent 22 is even with and is depressed by the weight 20, but not so long that when the door is closed the detent will have passed the weight 20 and be projected on the underside of this weight.

To prevent the weight 20 from striking the bottom of the track with force I provide the spring 25 at the bottom of the track which serves to cushion the descent of the weight and prevent the otherwise sudden shock which would result. The spring 25 may be positioned at any desired location along track 19 so that the urge toward open position of the door need not operate after the door has been opened to a prededetermined degree, which suitably may be that degree that permits a person to pass through the doorway.

Suitably the detent 22 may be beveled on the lower side of its forward end so that when the alarm has passed and the pressure within the chamber returns to normal, the door may simply be closed, which serves to raise weight 20 in its track, the contact of the beveled portion of the detent with the weight serving to withdraw the detent to allow the weight to pass.

A small auxiliary weight **20*b* which is much lighter than weight 20 is attached to cord 23 on the right hand side of pulley 27 (as shown in FIG. 2). When the door is closed as above described the weight 20 will draw the cord taut raising weight 20*b*, then the operator may pull on the cord to raise the weight to a further extent at which time the weight passes completely by the detent 22 and the detent is projected under the weight in this cocked position. When the operator then releases the cord the weight 20***b* descends to take up slack in the cord and keep the cord taut between the door 15 and the partition 19.

Also I provide a spring 18 which is disposed between the weight 20 and the bracket 18a which is attached to a track 19. This spring 18 is arranged to cushion the ascent of the weight 20 to the position shown in FIG. 2, and so prevent the slamming of the door when it is closed during the application of pressure on the inside of the chamber.

I prefer that the weight 20 be not sufficient to open the door when the weight is released, but only sufficient to compensate or partially compensate for the urge of the added pressure within the chamber toward the door to close it. In this condition the door will remain closed until a person exerts at least some pressure against the door to open it. Adjustment of the weight to accomplish this condition is easily made by adding or removing weight sections 20*a*.

To review the sequence of operation of the improved apparatus, when an alarm is made a signal is produced which serves to start the blower C in operation thus producing a pressure within chamber A. This signal operates also through electrical connections 26 to actuate the solenoid 21 which withdraws detent 22 from its position in which it supports weight 20. The force of weight 20 is then applied to cable 23 to door 15, tending to urge the door toward open position. But if the force of weight 20 is not sufficient to overcome the spring which normally functions to close the door plus the force of the added air pressure, the door will not then open. However, the door will open easily when anyone pushes against it. In this condition the force of the weight compensates or partially compensates for the effect on the door of the added air pressure due to the operation of blower C.

The weight 20 descends in its track as the door 15 is opened. When the weight contacts the spring 25 its movement is gradually brought to a stop, and any further opening of the door is governed only by the normal operation of the door.

When the emergency has passed and the blower is stopped and the alarm control brought to normal there is no longer an actuating signal and the door may be manually closed allowing the detent 22 to assume its original position in which it supports weight 20. In this condition the door may be opened and closed normally without interference from the special compensating mechanism D.

It may be further observed that spring 25 serves not only to prevent the crashing of weight 20 at the bottom of the track when the door is opened, but serves also to assist in starting the door from open toward closed position. This is especially helpful since when the door is open there will be little or no pressure exerted against the interior of the door due to the operation of the blower C.

While only one embodiment of my invention has been illustrated and described in detail it will be apparent to those skilled in this art that the invention may take many and varied forms and all such forms and structures are to be considered as within the spirit of the invention and contained within the scope of the appended claims.

I claim:

1. A device for assisting the opening of a door comprising a chamber having a door which opens into said chamber, means for providing a signal, means responsive to said signal for generating a pressure within said chamber and against said door to thereby produce a draft from the interior of said chamber to the exterior thereof when said door is opened, and means responsive to said signal for urging said door toward open position to compensate at least in part for said pressure which is applicable against said door, said means for urging said door including a track mounted within a vertical wall of said chamber, a weight within said track, means for supporting said weight at an inoperative position, a cable connected at one end to said door and at the other end to said weight, and including also an auxiliary weight smaller than said first-mentioned weight and which is attached to said cable at a point above said first-mentioned weight for preventing sagging of said cable between said door and said wall, and means responsive to said signal for rendering said supporting means inoperative whereby said urging means is brought into operation.

2. A device as set forth in claim 1 including a spring in said wall position to contact said weight when said door is closed and said weight is raised to thereby cushion said door against slamming.

3. A device for assisting the opening of a door comprising a chamber having a door which opens into said chamber, means for providing a signal, means responsive to said signal for generating a pressure within said chamber and against said door to thereby produce a draft from the interior of said chamber to the exterior thereof when said door is opened, and means responsive to said signal for urging said door toward open position to compensate at least in part for said pressure which is applied against door, said means for urging said door including a weight, means for supporting said weight at an inoperative position, said supporting means including a bolt extending under said weight, and means responsive to said signal for rendering said supporting means inoperative to bring said urging means into operation, said means for rendering said supporting means inoperative including a solenoid arranged to withdraw said bolt from under said weight upon receipt of said signal.

4. A device as set forth in claim 3 in which said bolt is equipped with a spring which presses it into its extended position under said weight, and in which said bolt is beveled on its underside at its forward end, whereby said bolt is retracted when said weight is moved upwardly past the bolt to allow said weight to pass and is thereafter extensible by action of said spring toward said position.

* * * * *